US009902123B1

(12) United States Patent
Hipol et al.

(10) Patent No.: US 9,902,123 B1
(45) Date of Patent: Feb. 27, 2018

(54) METHOD AND APPARATUS FOR PRODUCING LARGE UNIFORM THICKNESS NANOMATERIAL SHEETS

(71) Applicant: Innovatech Engineering, LLC, Tallahassee, FL (US)

(72) Inventors: Philip J. Hipol, Tallahassee, FL (US); David Haldane, Tallahassee, FL (US)

(73) Assignee: Innovatech Engineering, LLC, Tallahassee, FL (US)

( * ) Notice: Subject to any disclaimer, the term of this patent is extended or adjusted under 35 U.S.C. 154(b) by 1044 days.

(21) Appl. No.: 14/186,795

(22) Filed: Feb. 21, 2014

(51) Int. Cl.
*D21J 3/12* (2006.01)
*B30B 9/02* (2006.01)
*B30B 1/00* (2006.01)

(52) U.S. Cl.
CPC ..... *B30B 9/02* (2013.01); *B30B 1/00* (2013.01); *D21J 3/12* (2013.01)

(58) Field of Classification Search
CPC ..... D21J 3/00; D21J 3/12; D21J 1/04; D21H 15/00; D21H 15/02; D21H 11/00; D21H 11/16; D21H 11/18; D21H 11/20; D21C 9/18; B30B 9/02; B30B 9/04; C08B 15/00; C08B 15/02; C08B 15/08; C08J 5/18
USPC ..... 162/218–225, 387–416; 264/86, 87; 425/84, 85; 210/225, 770
See application file for complete search history.

(56) References Cited

U.S. PATENT DOCUMENTS 1,953,240 A * 4/1934 Laussucq ..... D21J 1/00 162/227
6,113,827 A * 9/2000 Styczynski ..... B29C 45/14336 264/161

* cited by examiner

*Primary Examiner* — Eric Hug
(74) *Attorney, Agent, or Firm* — American Patent Agency PC; Daniar Hussain

(57) ABSTRACT

A batch-automated microfiltration press for producing large uniform thickness nanomaterial sheets includes a filtration envelope of variable size that is defined between an upper platen having a fixed position and a lower platen disposed in spaced apart, parallel relation to the upper platen. The upper platen has a plurality of input nozzles and a plurality of flow dispersers associated with each of the input nozzles. Nanoparticles are deposited onto a fine filter membrane positioned in the filtration envelope. Flow channels and drain holes are formed in the lower platen. Each of the flow channels has a non-linear path of travel. A closed-loop fluid control system maintains a predetermined rate of nanoparticle deposition onto the fine filter membrane. A motion control system controls the raising and the lowering of the lower platen, maintaining a constant displacement instead of constant pressure, enabling the production of clean, undamaged sheets of nanomaterial papers.

18 Claims, 10 Drawing Sheets

METHOD AND APPARATUS FOR PRODUCING LARGE UNIFORM THICKNESS NANOMATERIAL SHEETS

BACKGROUND OF THE INVENTION

1. Field of the Invention

This invention relates to the fabrication of large uniform thickness sheets of nanomaterials, including micro-fibrillated cellulose, nano-crystalline cellulose, carbon fibers, nanotubes, nanofibers, and nanoparticles of other sources including but not limited to graphene, boron nitride nanotubes, quantum dots, fullerenes, and the like.

2. Description of the Prior Art

Nanomaterials can possess much greater strength, conductivity, surface area, and other attractive properties at a much lower weight than standard engineering materials such as wood, metals, plastics, and the like.

It is difficult to produce large, freestanding sheets of such materials with high levels of purity and nanomaterial content. Conventional manufacturing processes such as solvent casting, vapor deposition and the like require the use of additives, binders, surfactants and adhesives which reduce the purity and nanomaterial content, and thereby reduce the strength or other desirable properties of the resulting sheet. Vapor deposition is limited in scale and requires prohibitively expensive substrate preparations.

Alternative methods such as micro-filtration produce small sheets of high nanomaterial content. Sheet uniformity is sacrificed, however, if the micro-filtration process is scaled upwardly to produce larger sheets.

Thus there is a need for an apparatus and method for producing strong, uniform large sheets of high purity and high nanomaterial content.

Conventional microfiltration devices make sheets of nanomaterials by forcing an aqueous solution of nanomaterial particles through a filter at high pressures.

An alternative conventional method involves solvent casting, where the nanomaterials are mixed with solvents, additives, binders, adhesives, surfactants or combinations thereof and placed into sheet form. The solvent is dried off or evaporated, leaving a sheet of nanomaterial particles. It is not always possible to remove all of the solvents or other additives in sheets produced by solvent casting, thereby often reducing the mass or volume content of nanomaterials in the sheet. This process often does not produce sheets that retain their permeability.

Thus there is a need for an improved process for producing nanomaterial sheet materials that does not require the use of solvents, additives, binders, adhesives or combinations thereof.

Conventional microfiltration presses supply a constant pressure to the aqueous suspension of nanomaterial particles throughout the process. The deposition rate therefore decreases since the flow rate of the aqueous suspension decreases as the thickness of the nanomaterial sheet increases.

Thus there is a need for an improved deposition method so that the deposition rate can be controlled as the process continues.

Conventional microfiltration presses used for filter cake formation include a single inlet and nozzle in the feed platen which deposits the nanomaterial suspension onto the filter membrane resting on the drain platen. This commonly produces a dispersion of particles in the filter cake that is not uniform or homogeneous across the filter cake.

Thus there is a need for an improved apparatus that provides a more uniform or homogeneous dispersion of nanoparticles in the filter cake.

Conventional microfiltration presses include filter media supported by a stack of cloth that acts like a screen, which is then placed onto a support structure with holes formed therein through which the filtered effluent flows to a drain. This commonly produces sheets with a rough or uneven surface finish. The cloth is also prone to adhering to the thin sheets making them non-ideal for membrane formation applications, and the filter cake is often disrupted upon discharge.

There is a need, therefore, for an improved structure for supporting the filter media that produces a satisfactory surface finish on the filter cake and preserves the integrity of the filter cake upon discharge.

Conventional microfiltration presses have inefficient flow patterns that introduce non-homogeneous flow and non-homogeneous filter cake formation which results in papers of un-even or non-uniform thickness. Inefficient flow patterns underneath the filter stack which result from vortex formation/flow anisotropy cause uneven pressure underneath the membrane resulting in uneven membrane formation and reflux of the filtrate.

Thus there is a need for an improved press that includes efficient flow patterns and dispersers to reduce non-homogeneous flow and non-homogeneous filter cake formation.

Conventional microfiltration presses include an elastomeric O-ring gasket that is compressed between the platens to form the filter envelope. The O-ring is typically held in place by a groove or channel in one or both platens, but such O-rings have limited capabilities to withstand high pressures and the filter membrane is crushed or damaged when such high pressures are created and the filter membrane is forced into the O-ring groove or channel.

Thus there is a need for an improved gasket capable of withstanding the high pressures needed to obtain a uniform flow rate for the aqueous nanomaterial suspension while maintaining the integrity of the filter membrane.

Conventional microfiltration presses employ hydraulic cylinders which provide a constant clamping force during filtration process to hold the upper and lower platens together. At the end of the filtration process, the aqueous suspension of nanoparticles is expended and air enters into the filtration envelope. That air easily flows through the filter, causing the pressure within the filtration envelope to be reduced sharply. Since the clamping force must be supported only by the gasket, the gasket compresses, causing the upper and lower platens to crush the nanomaterial sheet.

Thus there is a need for an improved apparatus that does not rely upon hydraulic cylinders and which controls the offset or relative position between the upper and lower platens under various or modulating pressure so that the nanomaterial sheet is not crushed when the nanomaterial suspension is expended.

In view of the art considered as a whole at the time the present invention was made, it was not obvious to those of ordinary skill in the art how the needed improvements could be provided.

SUMMARY OF THE INVENTION

The long-standing but heretofore unfulfilled need for a device that can produce large uniform thickness sheets of nanomaterials is now met by a new, useful, and non-obvious invention.

The inventive structure includes an apparatus and method for producing large uniform thickness sheets of nanomaterials of variable size, shape and thickness.

More particularly, the novel apparatus includes an upper platen having a fixed position and a lower platen disposed in spaced apart, parallel relation to the upper platen. The lower platen is movably mounted so that a distance between the lower platen and the upper platen is controllable.

The upper platen has a plurality of input nozzles mounted therein and a plurality of flow dispersers with asymmetric fluid pathways associated with each of the input nozzles.

A gasket is disposed in underlying relation to the upper platen and a fine filter membrane is disposed in underlying relation to the gasket. Nanoparticles are deposited on the fine filter membrane when the press is operating.

A membrane support is disposed in underlying relation to the fine filter membrane, a drain substrate is disposed in underlying relation to the membrane support, a substrate sealpack is disposed around the edges of the drain substrate, and the lower platen is disposed in underlying relation to the drain substrate.

A plurality of flow channels and a plurality of drain holes are formed in the lower platen. Each of the flow channels follows a path of travel that interconnects two of the drain holes and each path of travel is non-linear.

A closed-loop fluid control system maintains a predetermined rate of nanoparticle deposition onto the fine filter membrane. The system includes a fluid controller, a source of compressed air, a motorized regulator under the control of the fluid controller, an input pressure gage that sends data to the fluid controller, a flow sensor that sends data to the fluid controller, a proportional valve under the control of the fluid controller, and an output pressure gage that sends data to the fluid controller.

Compressed air flows from the compressed air source, through a nanomaterial suspension, and to the lower platen. The nanoparticle deposition rate is thereby maintained at controlled levels while modulating both the pressure of the fluid and the volume of aqueous suspension that is allowed to flow through said upper and lower platens. In the current embodiment, the filtered effluent is removed from the lower platen by use of gravity flow. The removal of the filtered effluent can be enhanced by use of a partial or full vacuum to the drain system on the lower platen underneath the filter media.

A plurality of jack screws support the lower platen and control the distance between the lower platen and the upper platen.

A motion control system controls the operation of the motor that controls the raising and the lowering of the jack screws. The motor has an output shaft that raises the jack screws when rotating in a first direction and which lowers the jack screws when operating in a second direction opposite to said first direction.

A rotary encoder produces digital data representing the rotational position of the output shaft, hence the amount of extension or retraction of the jack screws relative to a predetermined starting point, and therefore the distance between the upper and lower platens;

A motion controller controls the motor and receives signals from the rotary encoder. An upper limit switch prevents raising of the lower platen beyond its predetermined maximum height and a lower limit switch prevents lowering of the lower platen below its predetermined minimum height, and allows the rotary encoder to be set to its starting point.

The motion control system maintains a constant displacement instead of constant pressure, enabling the production of clean, undamaged sheets of nanomaterial papers.

An aqueous suspension of nanomaterial particles flows between the upper and lower platens through the filter membrane under high pressure. The pressure can range from 5 to 200 psi, depending on the types of nanomaterials used, the concentration of the nanomaterial suspension, the type of filter membrane used, and the desired thickness and density of the nanomaterial sheet.

The novel fluid and motion control means ensure a high pressure capability, uniform flow, even dispersion, and stable deposition rate of the nanomaterial particle suspension onto the filter membrane.

The fine filter membrane collects the nanomaterial particles, and the high pressure causes controlled de-wetting, molecular bonding and entanglement among the particles, resulting in a large sheet of uniform thickness with an extremely high content of desired nanomaterials.

The primary object of this invention is to create large, uniform thickness sheets with an extremely high content of nanomaterials without the use of undesirable binders, fillers or adhesives.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
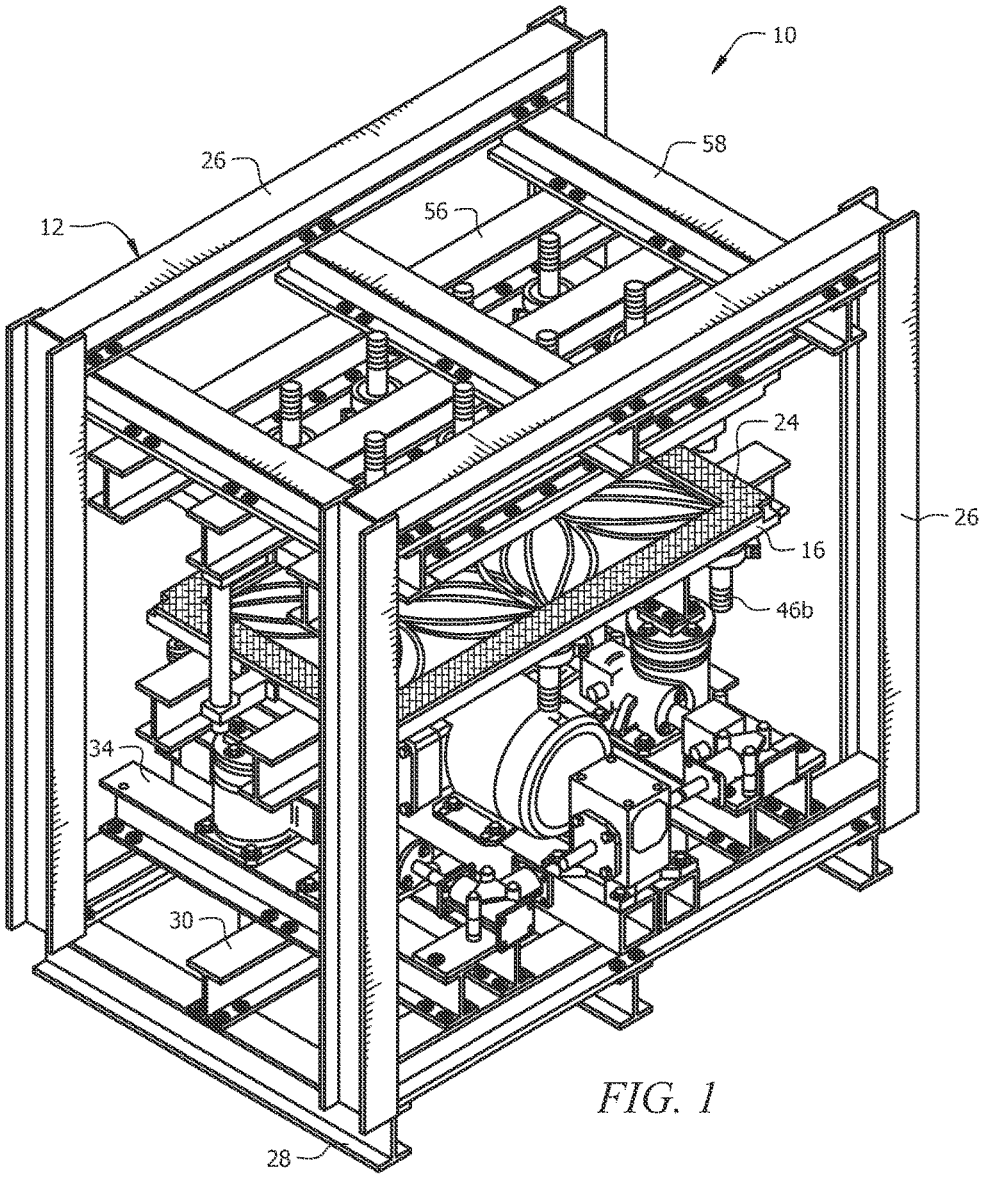
FIG. 1 is a rear perspective view of the novel structure.
Figure 2:
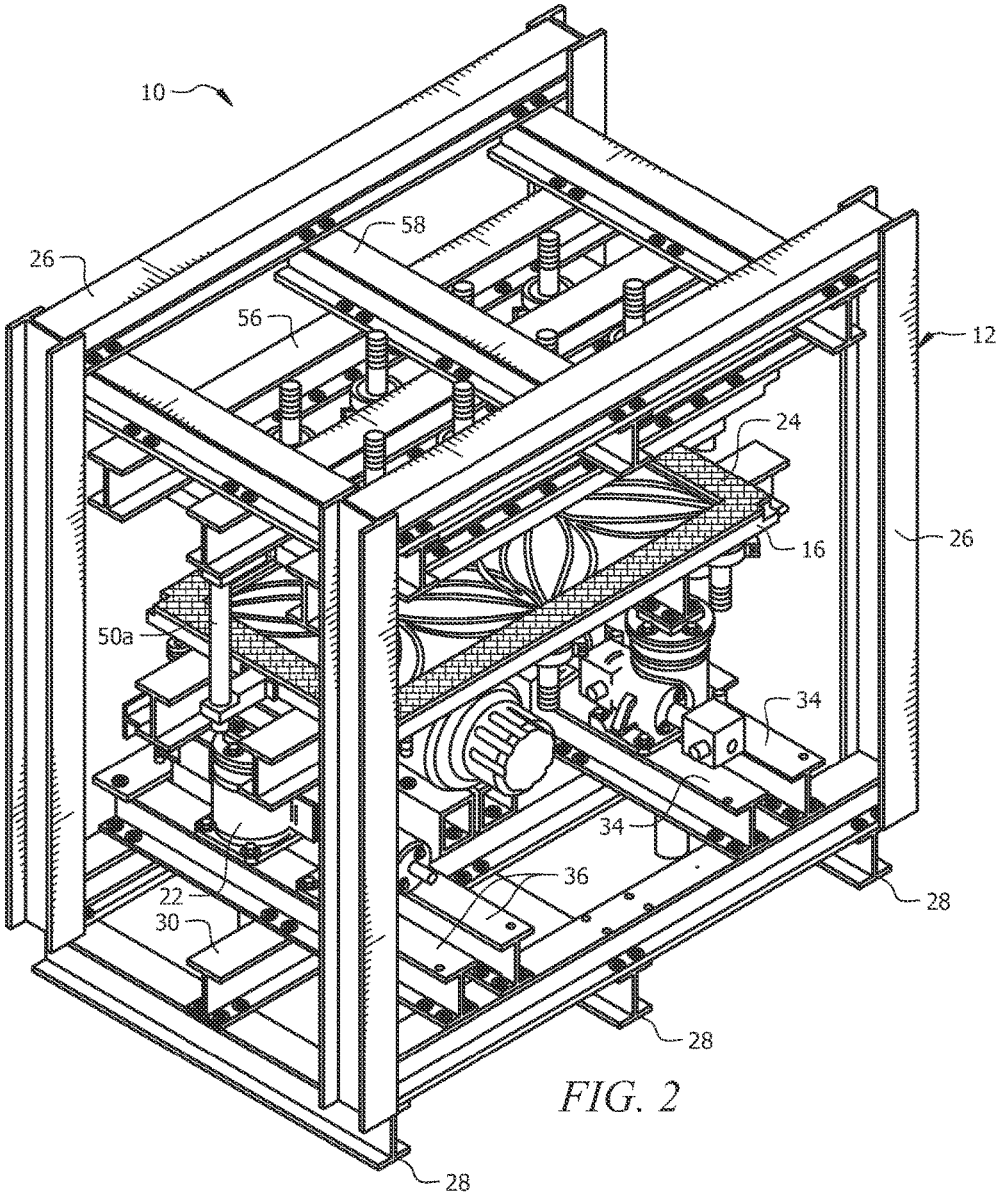
FIG. 2 is a front perspective view thereof.
Figure 3:
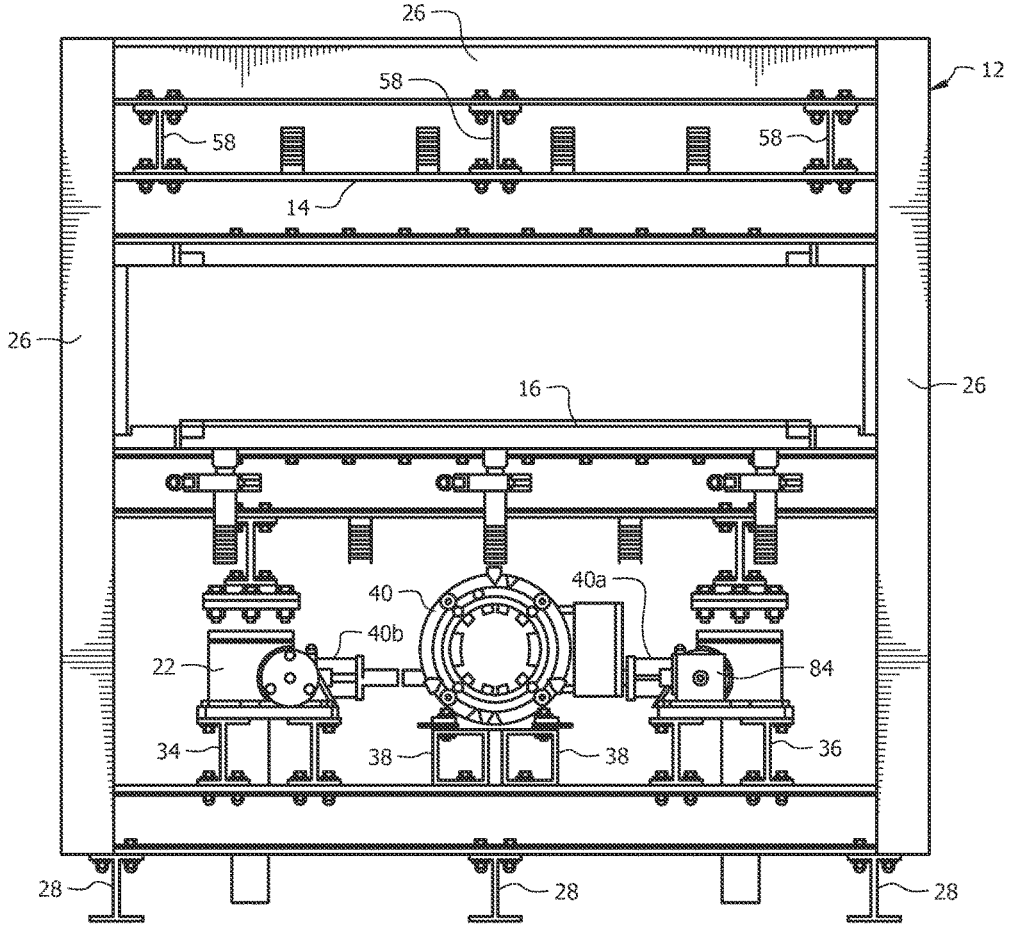
FIG. 3 is a front elevation view thereof.

Structure 10 depicted in FIGS. 1-7 is a preferred structure. The front and rear perspective views of FIGS. 1 and 2 disclose frame 12 to which the various parts are mounted but those parts are best seen in the exploded view of FIG. 7. Upper platen 14, lower platen 16, fine filter media 18, nanoparticles 20, jack screws 22, gasket 24 and the other main elements of the invention can be connected to one another in many different ways and on differing frames and not just in the specific ways on the particular frame depicted.

Figure 7:
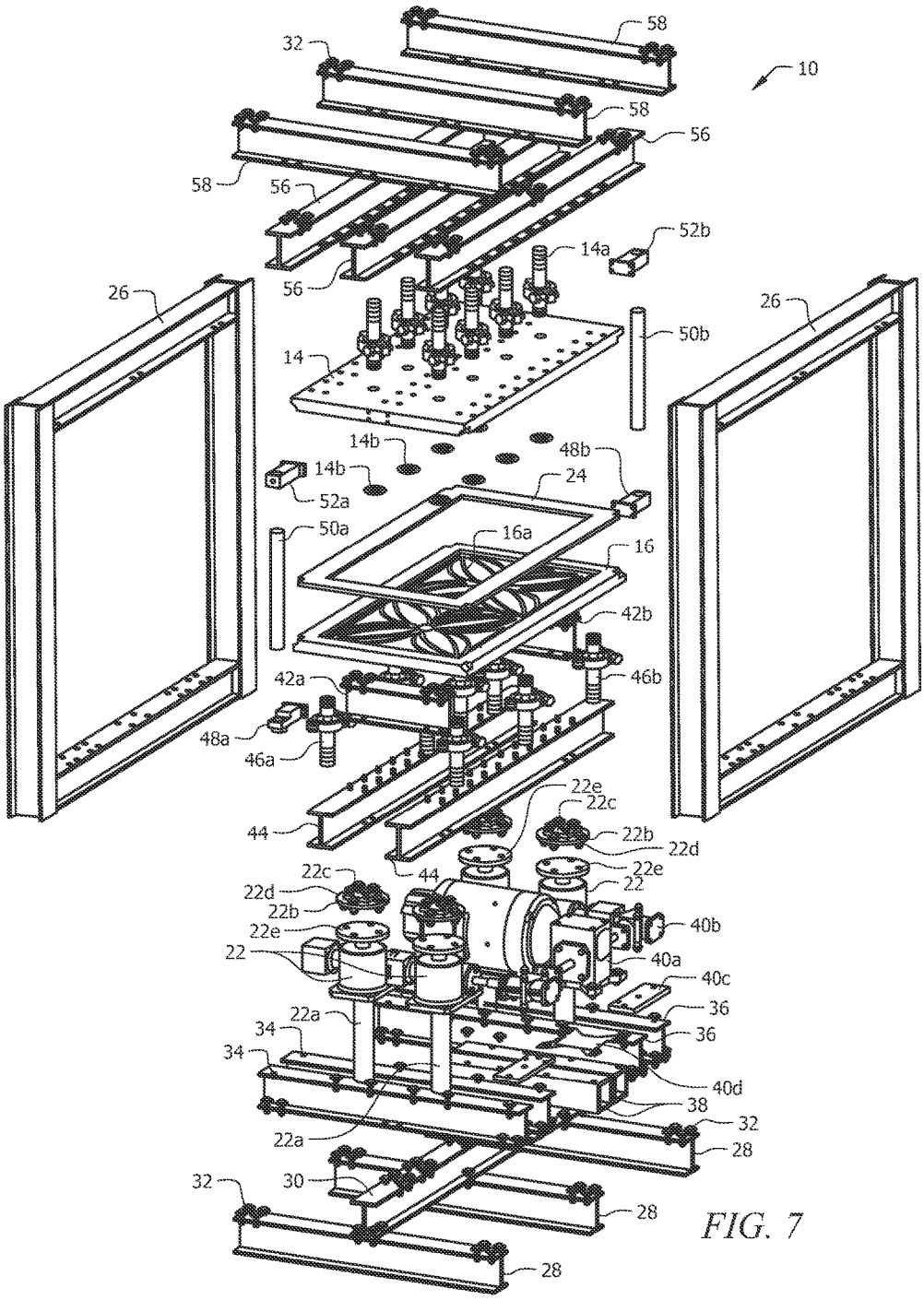
FIG. 7 is an exploded front perspective view thereof.

Referring therefore to FIG. 7, there it will be seen that structural side frames 26, 26 are rectangular in this preferred embodiment and are positioned parallel to one another in respective vertical planes. They are longitudinally disposed as drawn relative to transversely disposed, equidistantly spaced apart I-beams, collectively denoted 28, that form the foundation of novel batch-automated microfiltration press 10 and which overlie a floor, a table top, or other support surface, not depicted. Said support beams 28 underlie side frames 26, 26 as best depicted in FIGS. 1-4.

Central load beam 30 is longitudinally disposed and overlies each support beam 28 at the center of each support beam. I-beam hardware, collectively denoted 32 throughout FIG. 7, provides the preferred interconnection means for all I-beam to I-beam connections throughout the novel structure.

A first pair of jack screw mounting I-beams, collectively denoted 34, is transversely disposed atop a first end of central load beam 30 and a second pair of jack screw mounting I-beams, collectively denoted 36, is transversely disposed atop a second end of central load beam 30. A pair of box frame motor mounting beams, collectively denoted 38, is transversely disposed atop said central mounting beam 30 mid-length thereof, in centered and equidistantly spaced relation to said pairs 34 and 36 of jack screw mounting beams.

A first pair of jack screws 22 is supported by jack screw supports 22*a*, 22*a* associated with the first pair of mounting beams 34 and a second pair of said jack screws is similarly supported by a second pair of jack screw supports 22*a*, 22*a* associated with mounting beams 36. A small extent of said second pair of jack screw supports can be seen upon careful inspection of FIG. 7 but said partially visible supports are un-numbered to avoid cluttering of the drawing.

A load plate 22*b* having platen connectors 22*c* surmounts each jack screw 22. Items 22*d* are load pad connectors/fasteners, said fasteners attaching load plate 22*b* to jack-screw load pad 22*e*.

Motor 40 is transversely disposed between the first and second pair of jack screws and is supported by said pair of box frame mounting beams 38. Speed reducer 40*a* forms a part of motor 40. Item 40*b* is a two (2)-way miter block, there being one (1) of said miter blocks on each side of speed reduced 40*a* because motor 40 is between said two sets of jack screws 22, i.e., each miter block transmits the torque of the output shaft of motor 40 ninety degrees (90°) so that one (1) motor can drive four (4) jack screws. Items 40*c*, 40*c* are miter box mounting plates, and item 40*d* is a shim for gearbox 40*a*. Washers or other suitable spacers, not depicted, raise miter blocks 40*b*, 40*b* up to the elevation of gear reducer 40*a* if needed.

Transversely disposed first jack screw beam 42*a* overlies and engages the platen connectors 22*c* associated with the first pair of jack screws 22 and transversely disposed second jack screw beam 42*b* overlies and engages the platen connectors 22*c* associated with the second pair of jack screws 22.

Figure 4:
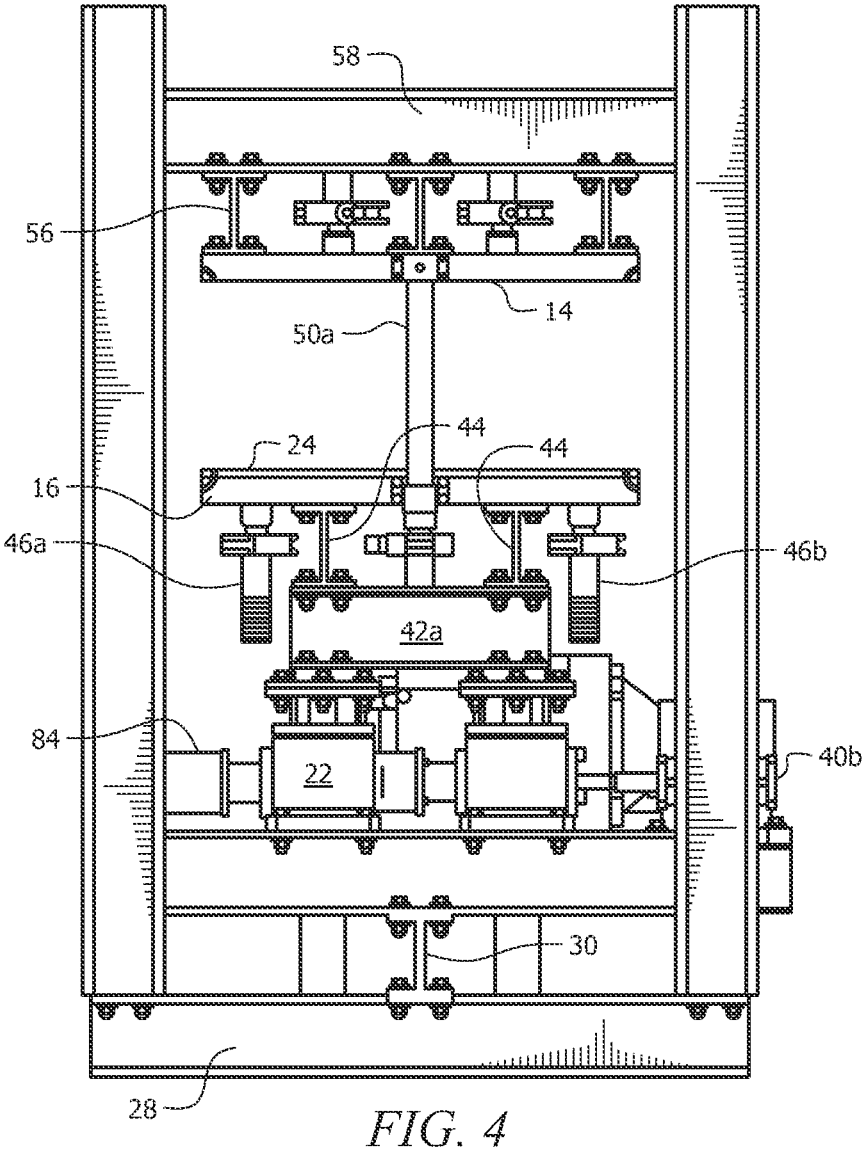
FIG. 4 is an end view thereof.
Figure 5:
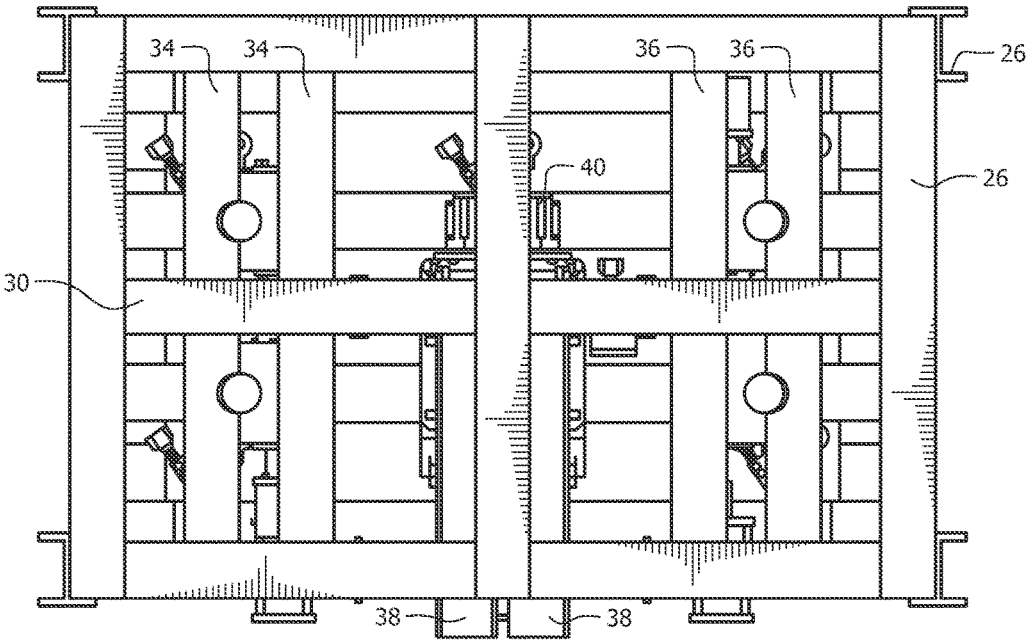
FIG. 5 is a bottom plan view thereof.
Figure 6:
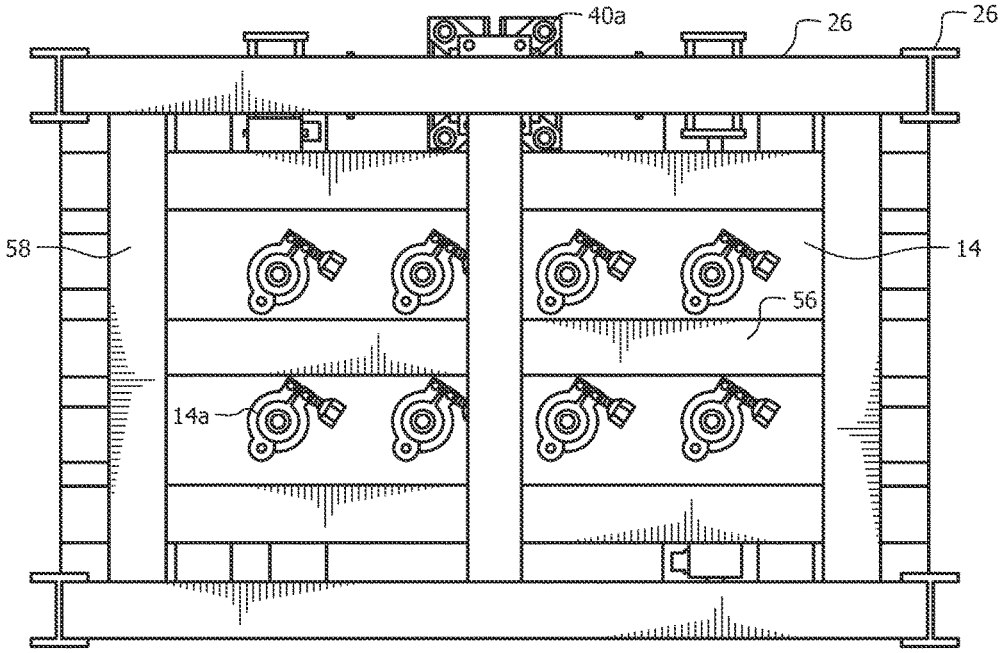
FIG. 6 is a top plan view thereof.

Each bracer of a pair of longitudinally disposed lower platen bracers, collectively denoted 44, has a first end that overlies jack screw beam 42*a* at opposite ends of said jack screw beam as perhaps best depicted in FIG. 4 and each bracer of said pair has a second end that overlies jack screw beam 42*b* at opposite ends of said jack screw beam 42*b*.

Lower platen bracers 44 thus are displaced upwardly and downwardly as jack screws 22 are displaced upwardly and downwardly.

Lower platen 16 overlies and is secured by I-Beam hardware 32 to each lower platen bracer 44, 44 and a plurality of NPT sanitary plumbing adaptors, collectively denoted 46*a* and 46*b*, depend from opposite sides of said lower platen as perhaps best depicted in said FIG. 4. Items 44*a* are platen connectors. Adaptors 46*a*, 46*b* perform the function of draining the filtered effluent from the filtration envelope.

First bushing block 48*a* is secured to a first end of lower platen 16 and second bushing block 48*b* is secured to a second end of said lower platen 16, said first and second bushing blocks being disposed along the longitudinal axis of symmetry of said lower platen.

Lower platen 16 is re-positioned from a lower "loading" position to an upper "operating" position using jack screws 22 or other similar position controlling devices.

Upper platen 14 is horizontally disposed in vertically spaced apart, parallel relation to lower platen 16 and first and second alignment shaft capture blocks 52*a*, 52*b* are secured to opposite ends of said upper platen at its longitudinal axis of symmetry. Items 14*a* are input nozzles and items 14*b* are dispersion inserts that perform the function of flow dispersers, i.e., they are influent flow disrupters.

First vertical alignment post 50*a* interconnects first bushing blocks 48*a*, 52*a* and second vertical alignment post 50*b* interconnects second bushing blocks 48*a*, 52*b*. Bushing blocks 48*a* and 48*b* are apertured to slidingly receive vertical alignment posts 50*a* and 50*b* so that lower platen 16 may be moved toward and away from fixed position upper platen 14 by jack screws 22.

Novel gasket 24 is sandwiched between said lower and upper platens as best depicted in the exploded view of FIG. 7. The above-mentioned channels that enhance the flow of the effluent or filtrate are formed in lower platen 16 and are denoted generally by the reference numeral 16*a*. In this particular example, thirty two (32) arcuate flow channels 16*a* are formed in lower platen 16, including eight (8) groupings of four (4) flow channels each.

Upper platen bracers, collectively denoted 56, are longitudinally disposed and overlie said upper platen. Platen connectors, collectively denoted 56*a*, interconnect platen braces 56 to upper platen 14. Upper beams, collectively denoted 58, are transversely disposed and overlie said upper platen bracers. The opposite ends of said upper beams 58 are secured to the underside of the top rail of each structural side frame 26, 26. That arrangement of parts prevents movement of said upper beams 58, upper platen bracers 56, and upper platen 14.

Figure 8A:
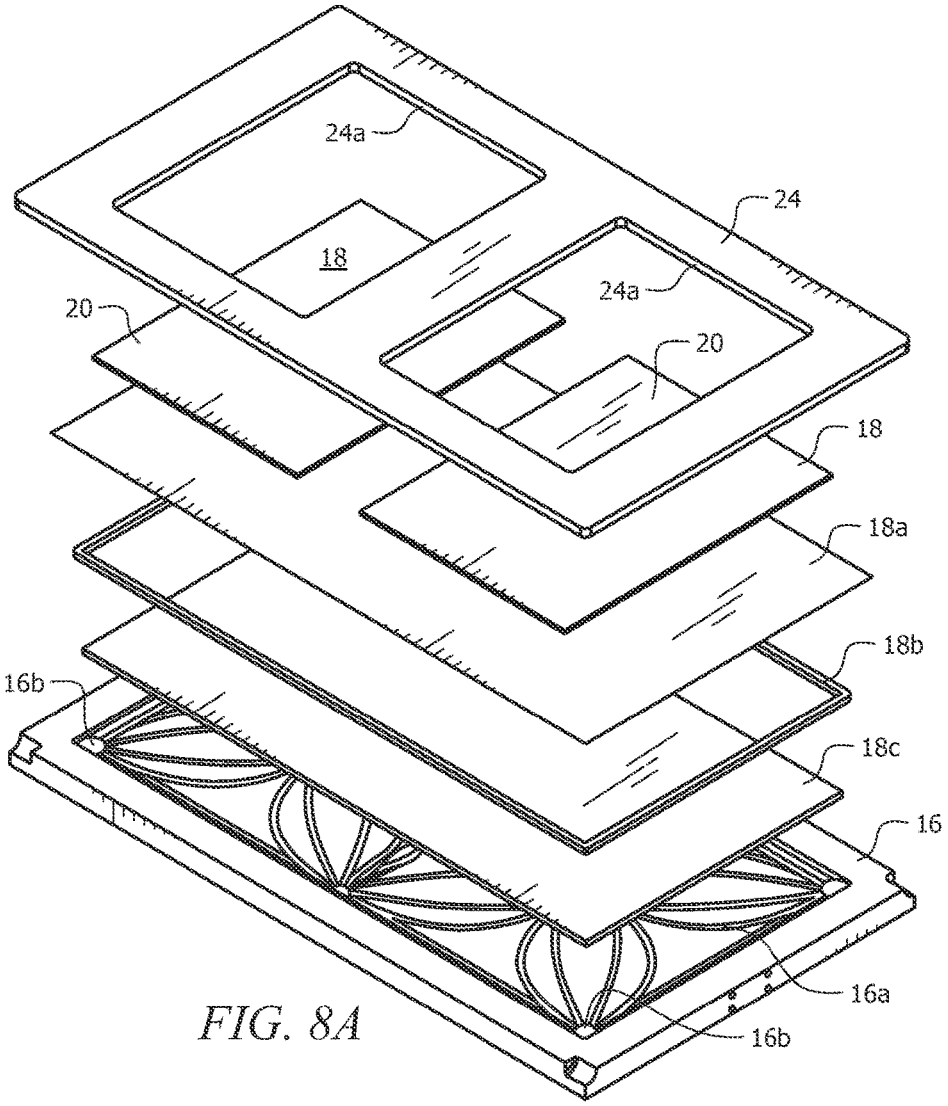
FIG. 8A is an exploded perspective view of the lower platen assembly.
Figure 8B:
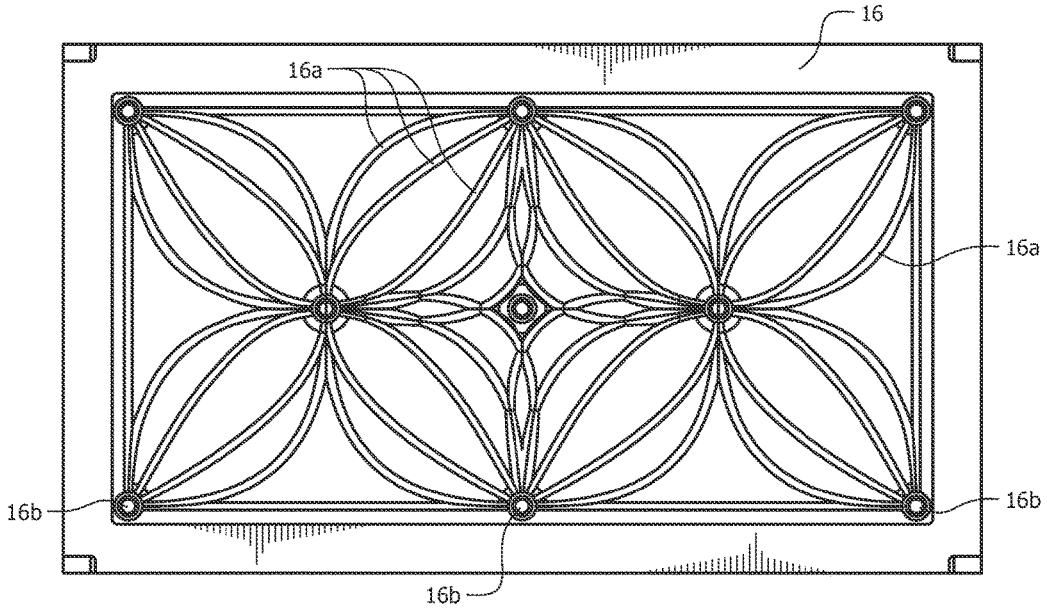
FIG. 8B is a top plan view of the lower platen.

FIGS. 8A and 8B disclose the parts associated with lower platen 16 in greater detail. As depicted in FIG. 8A, gasket 24 has two windows 24*a*, 24*a* formed and a fine filter membrane 18 is in registration with each of said windows. Nanoparticles 20 are deposited on said filter media 18 but due to their small size are indicated with said reference numeral 20 but are not depicted. Membrane support 18*a* underlies filter media 18 and provides support therefor.

The novel structure employs a novel porous sintered metallic substrate to support filter media 18, thereby eliminating the stack of cloth of the prior art. This substrate presents a smooth surface to the filter media, thereby improving the surface finish of the paper. The substrate also incorporates micron-sized holes (1-200 μm) which are capable of passing the filtered effluent, and which also promotes cross flow of the effluent, thereby improving the dispersion of the nanomaterial suspension and uniformity of deposition of the nanoparticles onto the filter.

Item 18*b* is a substrate sealpack that prevents or inhibits reflux and item 18*c* is a drain substrate. Membrane support 18*a* provides support and a smooth surface for the filter media. The membrane support can be a fibrous cloth, plastic mat, or metal sheet material.

The smooth micro-porous substrate on which filter media 18 is supported promotes unrestricted cross flow, enables improved dispersion, uniformity and surface finish of the nanoparticle sheet.

The filtration envelope is defined by the bottom surface of the top platen, the top surface of the filter media and the inside edges of the cut-out in the gasket.

A high pressure is created within the filtration envelope in order to densely pack the nanoparticles and ensure a constant deposition rate onto fine filter membrane 18.

Flat elastomeric gasket 24 has considerable surface area that is clamped along flat surfaces of the upper and lower platens. The high clamping force between the upper and lower platens adequately constrains gasket 24 to enable higher pressures within the filtration envelope. Higher pressure flows are accommodated by increasing the width of the gasket, enabling greater surface area.

The higher pressures during sheet fabrication improves intermolecular bonding and tangling of the nanomaterial particles, resulting in a stronger sheet of paper. Gasket 24 is depicted in a rectangular shape but it can be provided in any practical predetermined configuration that can produce an operable filtration envelope, thereby enabling creation of arbitrarily shaped nanomaterial papers.

As best depicted in FIG. 8B, all flow channels 16*a* are in fluid communication with associated drain holes 16*b*. The flow channels avoid the central drain hole as depicted to prevent the formation of a large vortex and resulting flow anisotropy, which would cause an uneven sheet formation. The central drain hole is fed by cross-flow in the drain material, and has sloped sides that allow effluent passage if a sufficient flow rate is present in the flow channels. Grooves or flow channels 16*a* and said drain holes 16*b* efficiently drain the filtered effluent, reducing flow anisotropy and turbulence, improving dispersion and uniformity. Said grooves and drain holes also promote homogeneous dispersion and deposition of the nanomaterials onto filter media 18 and speed filter cake formation.

In the current embodiment, gravity is used to drain the filtered effluent from the lower platen. To further promote homogeneous dispersion of the nanomaterials on the filter media and to increase effluent flow rate, a vacuum can be applied at the drain holes to overcome higher effluent viscosities, developing flow anistropies or less than desired effluent flow rates.

The depicted novel pattern of grooves 16*a* and drain holes 16*b* minimizes vortex formation and flow anisotropy of the effluent. This enables faster, more efficient flow of the nanomaterial suspension through the filter, and results in the production of nanomaterial sheets having uniform thickness.

More specifically, when a fluid flows through a closed geometry in a turbulent fashion, intersecting fluid flow direction/force vectors cause anistropic pressure conditions in the dynamic flow geometry of the fluid system, resulting in eddies, waves and vortices. These anistropic pressure conditions below the filter material will cause irregular flow velocities through the filter membrane, and therefore uneven or non-uniform deposition rates, across the filter media.

The pattern of the grooves is determined by taking into consideration the geometry of the solid pocket that the drain material resides in, the viscosity of the effluent fluid, and the expected flow rate range to which the system will be exposed. The grooves are then placed along the lines of flow vector collision where anistropic pressure conditions will take place. In the current embodiment, consideration of flow anistropy is taken to the third ($3^{rd}$) order of calculating these flow vector collisions. For a system which would have higher effluent flow velocities it would be advantageous to calculate groove positioning beyond the third ($3^{rd}$) order, and for a system with lower effluent flow or viscosity it would be possible to reduce the number of grooves.

More particularly, grooves 16*a* which are used to channel away the filtered effluent are provided in a recess on the top of lower platen 14. Drain substrate 18*c* sits within the recess. The depth of the recess is equal to the height of drain substrate 18*c*, so the surface appears to be flat. Substrate sealpack 18*b* prevents effluent from flowing out of the recess in the lower platen that goes around the substrate. Membrane support 18*a* helps provide a smooth surface to the paper, as it does not allow the pattern of the substrate to show up on the paper. It also promotes cross-flow of the effluent, enabling a more uniform thickness paper. Filter media 18 is a hydrophilic or hydrophobic microporous or nanoporous flat polymer, metal or cellulose sheet membrane containing discrete holes, or it can be a mat-like material.

Figure 9A:
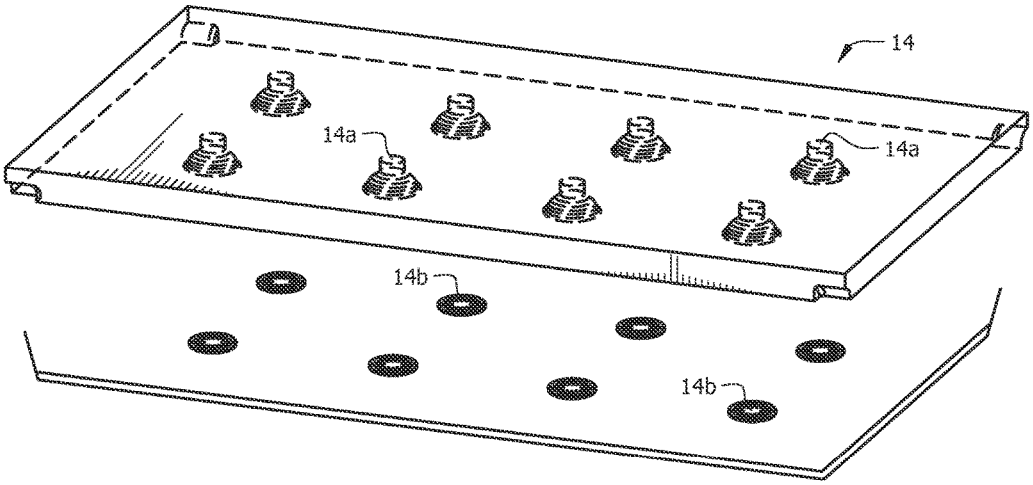
FIG. 9A is an exploded perspective view of the upper platen assembly.

FIG. 9A is an exploded view of upper platen 14. In order to ensure a homogeneous dispersion of the nanomaterial suspension, upper platen 14 having a plurality of inlets, also known as input nozzles. As depicted in FIG. 9A, the input nozzles are collectively denoted 14*a*. At least one flow disperser, a plurality of which is collectively denoted 14*b* in FIG. 9A, is used within each inlet to disperse the flow homogeneously. This design is inherently scalable to larger nanomaterial sheet sizes, as each input nozzle 14*a* is capable of supplying and dispersing the nanomaterial suspension according to a certain desired surface area. A larger number of nozzles can therefore be used to produce a larger sheet size.

Figure 9B:
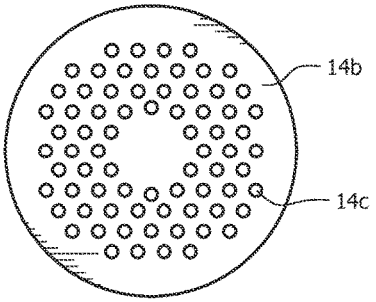
FIG. 9B is a plan view of a novel flow disperser.
Figure 9C:
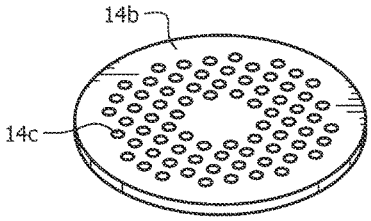
FIG. 9C is a perspective view of the novel flow disperser.
Figure 9D:
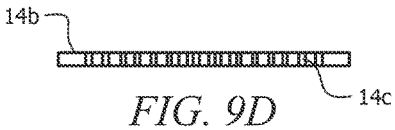
FIG. 9D is a side elevation view of the novel flow disperser.

Flow dispersers 14*b* are depicted with enhanced detail in FIGS. 9B-D. Each flow disperser is a rigid, flat disc as depicted with a large number of through apertures formed therein. Flow dispersers 14*b* significantly improve the dispersion of the nanomaterials onto fine filter membrane 18. As depicted, the center of each flow disperser 14*b* is imperforate and the preselected pattern of holes that is radially outward of that imperforate center does not follow a radial symmetric pattern. The pattern maximizes turbulent flow, and thereby improves dispersion of the nanomaterial suspension.

During normal operation, an aqueous suspension of nanomaterial particles flows between platens 14 and 16 through fine filter membrane 18 under high pressure. The two platens, together with gasket 24, filter media, membrane support and drain substrate create a filtration envelope within which nanoparticles 20 are deposited onto fine filter membrane 18 and the paper is formed.

The aqueous solution of nanomaterial particles does not require use of binders, fillers or adhesives and enables a stronger sheet of nanomaterial paper.

The pressure and flow characteristics of the nanoparticle suspension must be controlled with precision in order to produce high strength, large and uniform thickness papers with intentional through-thickness nanostructures. The novel structure advances the art by incorporating various novel means to provide the nanomaterial particle suspension under high pressure, constant flow and uniform deposition rate onto fine filter membrane 18.

More particularly, during the filtration process, the filter media is initially devoid of nanomaterial particles and gradually collects said nanoparticles to form a paper. Since flow of the suspension is continuously restricted by the nanomaterial particles, the amount of pressure needed to ensure a constant deposition rate of the nanoparticles onto the filter media must increase. A decrease in deposition/flow rate can result in lower density, creating an inhomogeneous through-thickness nanostructure.

As mentioned above, conventional microfiltration presses supply a constant pressure to the aqueous suspension of nanomaterial particles throughout the process and the deposition rate therefore decreases.

The present invention employs a novel closed-loop fluid control system in which the nanoparticle deposition rate is maintained at controlled levels while modulating both the pressure of the fluid and the volume of aqueous suspension that is allowed to flow through the platens.

Figure 10:
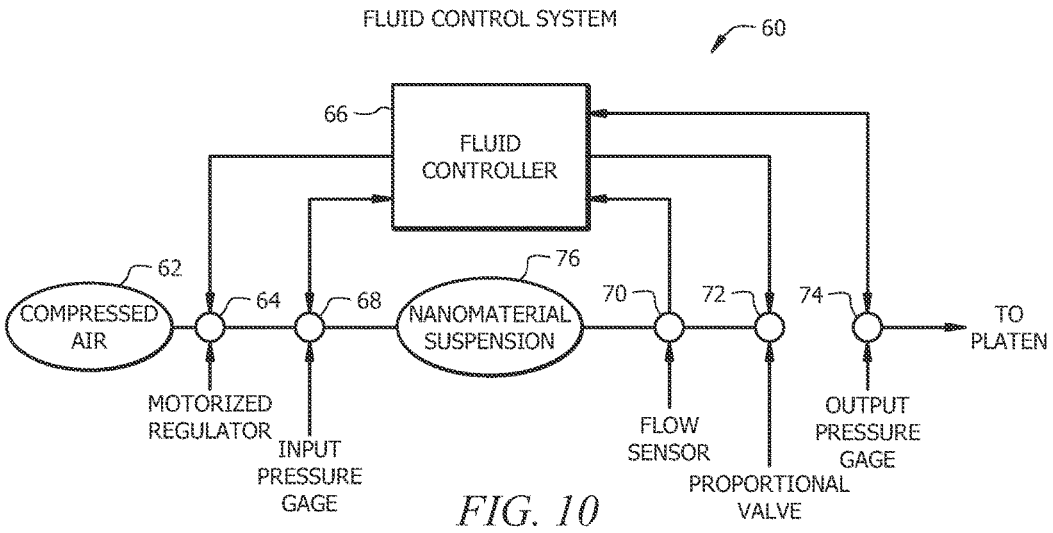
FIG. 10 is a diagram of the novel fluid control system.

The closed loop fluid control system is depicted in FIG. 10. It controls nanomaterial suspension supply pressure and flow volume, enabling a uniform nanomaterial deposition rate, resulting in a uniform thickness sheet.

More particularly, as depicted in said FIG. 10, novel fluid control system 60 includes a source of compressed air 62, motorized regulator 64 under the control of fluid controller 66, input pressure gage 68 that sends data to said fluid controller 66, flow sensor 70 that sends data to fluid controller 66, proportional valve 72 under the control of fluid controller 66, and output pressure gage 74 that sends data to fluid controller 66. The compressed air flows from compressed air source 62, through a tank or pressure vessel containing the nanomaterial suspension 76, and from there to input nozzles on upper platen 14*a*.

To prevent the lower platen from crushing the nanomaterial sheet when air is introduced into the filtration envelope at the end of the process, jack screws 22 provide a constant displacement (or offset) between the upper and lower platens. When the aqueous suspension is expended, the pressure within the filtration envelop may decrease without resulting in relative movement between the upper and lower platens, thereby eliminating the potential for the paper to be crushed.

Figure 11:
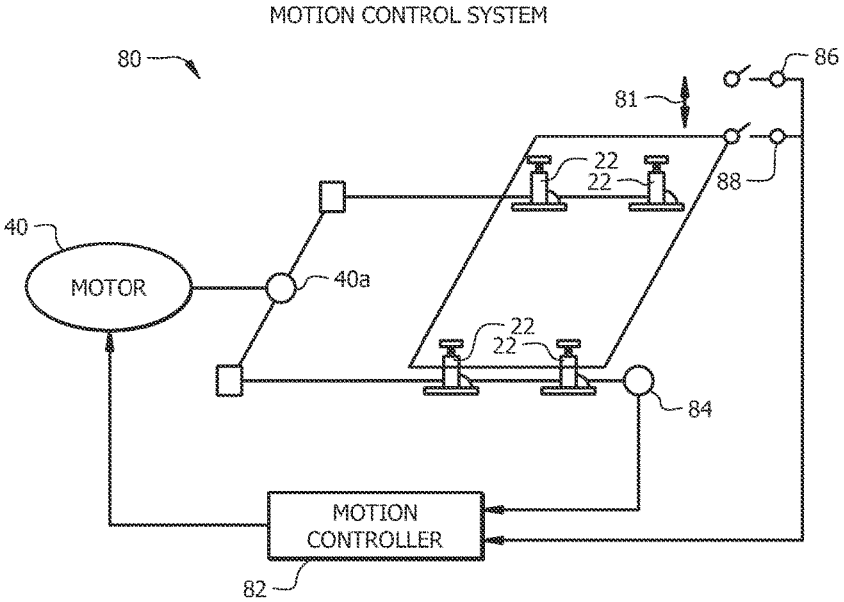
FIG. 11 is a diagram of the novel motion control system.

The motion control system is diagrammatically depicted in FIG. 11 and is denoted 80 as a whole. Motion controller 82 receives input signals from rotary encoder 84, upper limit switch 86 and lower limit switch 88. Rotary encoder 84 converts the physical rotational position of the output shaft of motor 40 and gear reducer 40*a* into digital signals. Lower platen 16 is raised and lowered by jack screws 22 as indicated by double-headed directional arrow 81, each of said jack screws being raised when the output shaft rotates in a first direction and each being lowered when the output shaft rotates in an opposite direction to said first direction. The amount of up or down travel of the jack screws is known for each rotation of the output shaft so motion controller 82 knows the distance of lower platen 16 from each limit switch 84, 86 and the travel speed and direction of travel of said lower platen at all times.

Motion control system 80 thus maintains a constant displacement instead of constant pressure, enabling the production of clean, undamaged sheets of nanomaterial papers.

The novel nanomaterial sheet fabrication process produces stronger and lighter sheets with a higher content of nanomaterials that have uniform thickness and a larger surface area.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A method for producing uniform thickness nanomaterial sheets with a batch automated microfiltration press comprising an upper platen and a lower platen, comprising the steps of:

dispersing an aqueous suspension of nanoparticles through a plurality of input nozzles mounted on said upper platen, wherein at least one of said input nozzles is associated with a flow disperser, wherein said upper platen has a fixed position, wherein a gasket is positioned in an underlying relation to said upper platen, wherein a fine filter membrane is placed in an underlying relation to said gasket so that said aqueous suspension of nanoparticles is dispersed on said fine filter membrane, wherein a bottom surface of said upper platen, a top surface of said fine filter membrane, and inside edges of a cut-out window of said gasket form a filtration envelope, and wherein said lower platen is positioned in a spaced-apart and parallel relation to said upper platen, and being movably mounted so that a distance between said lower platen and said upper platen is controllable; and producing a uniform thickness nanomaterial sheet by creating a nanoparticle suspension pressure within said filtration envelope to filter said aqueous suspension of nanoparticles through said fine filter membrane.

2. The method of claim 1, wherein a porous drain substrate comprising a plurality of holes is positioned in an underlying relation to said fine filter membrane, and wherein said lower platen is positioned in an underlying relation to said drain substrate.

3. The method of claim 1, further comprising the step of:

draining a filtered effluent through said lower platen, wherein said lower platen comprises a plurality of flow channels formed therein and a plurality of drain holes formed therein, and wherein each of said flow channels follows a non-linear path of travel that interconnects at least two of said drain holes.

4. The method of claim 1, wherein said nanoparticle suspension pressure is controlled by a closed-loop fluid control system that maintains a predetermined rate of nanoparticle deposition onto said fine filter membrane.

5. The method of claim 4, wherein a plurality of jack screws are provided for raising and lowering said lower platen, wherein said lower platen is lowered after said uniform thickness nanomaterial sheet is produced, to maintain a constant displacement between said upper and lower platens, wherein a single motor is provided for controlling each jack screw of said plurality of jack screws, and wherein a motion control system controls said motor.

6. The method of claim 2, wherein said drain substrate comprises a sintered metallic material.

7. The method of claim 2, wherein said drain substrate is positioned within a recess on said lower platen, wherein a depth of said recess is equal to a height of said drain substrate.

8. The method of claim 2, wherein a membrane support is positioned in an underlying relation to said gasket, wherein a substrate sealpack is positioned in an underlying relation to said membrane support, and wherein said drain substrate is positioned in an underlying relation to said substrate sealpack.

9. The method of claim 8, wherein said membrane support is selected from the group consisting of a fibrous cloth, a plastic mat, and a metal sheet, and wherein said membrane support has a smooth upper surface.

10. The method of claim 1, wherein said fine filter membrane is selected from the group consisting of a hydrophilic or hydrophobic flat polymer, a cellulose sheet membrane containing discrete holes, and a mat-like material.

11. The method of claim 1, wherein said gasket is flat, elastomeric, and constrained by flat surfaces of said upper and lower platens.

12. The method of claim 1, wherein an outer peripheral shape of said gasket conforms to said upper and lower platens, and wherein said cut-out window has a shape desired for said nanomaterial sheet.

13. The method of claim 1, wherein said gasket comprises more than one cut-out window, and wherein each of said cut-out windows is positioned in an underlying relationship to at least one of said input nozzles.

14. The method of claim 1, wherein a center of said flow disperser is imperforate, wherein the flow disperser has a plurality of through apertures formed therein, radially outward of said center, and wherein a formation pattern of said through apertures is not radially symmetric.

15. The method of claim 3, wherein said plurality of drain holes comprises a central drain hole positioned at a central location on said lower platen, wherein said plurality of flow channels avoids said central drain hole, and wherein said central drain hole comprises a sloped side.

16. The method of claim 3, wherein a first drain hole positioned at a corner of said gasket is connected by at least four non-linear flow channels to a second drain hole that is closest in distance to said first drain hole, and wherein said at least four non-linear flow channels are bilaterally symmetric about a straight line connecting said first and second drain holes.

17. The method of claim 3, further comprising the step of: applying a vacuum to said plurality of drain holes.

18. The method of claim 3, wherein each of said plurality of flow channels does not intersect with one another.

* * * * *